US005566220A

United States Patent [19]

Saito et al.

[11] Patent Number: 5,566,220

[45] Date of Patent: Oct. 15, 1996

[54] X-RAY COMPUTERIZED TOMOGRAPHY APPARATUS

[75] Inventors: Yasuo Saito, Tochigi-ken; Mitsuru Yahata, Ootawara; Tadaharu Kobayashi; Masahiko Yamazaki, both of Tochigi-ken, all of Japan

[73] Assignee: Kabushiki Kaisha Toshiba, Kawasaki, Japan

[21] Appl. No.: 378,095

[22] Filed: Jan. 25, 1995

Related U.S. Application Data

[63] Continuation of Ser. No. 160,727, Dec. 2, 1993, abandoned.

[30] Foreign Application Priority Data

Dec. 4, 1992 [JP] Japan ..... 4-325159
Mar. 18, 1993 [JP] Japan ..... 5-057645

[51] Int. Cl.[6] ..... H01J 35/00

[52] U.S. Cl. ..... 378/138; 378/113; 378/145

[58] Field of Search ..... 378/138, 137, 378/207, 4, 113, 205, 10, 145

[56] References Cited

U.S. PATENT DOCUMENTS 4,713,833 12/1987 Turner et al. ..... 378/138
4,730,353 3/1988 Ono et al. ..... 378/138
4,803,711 2/1989 Tsujii et al. ..... 378/4
4,827,494 5/1989 Koenigsberg ..... 378/207
5,060,254 10/1991 de Fraguier et al. ..... 378/138
5,065,420 11/1991 Levene ..... 378/137
5,265,142 11/1993 Hsieh ..... 378/4

FOREIGN PATENT DOCUMENTS

0467532A2 1/1992 European Pat. Off. ..... 364/413.15

*Primary Examiner*—Jack B. Harvey
*Assistant Examiner*—Xuong M. Chung-Trans
*Attorney, Agent, or Firm*—Finnegan, Henderson, Farabow, Garrett & Dunner, L.L.P.

[57] ABSTRACT

In an X-ray computerized tomography apparatus, a water phantom is interposed between an X-ray tube unit and an X-ray detector in place of a subject under examination and a plurality of pieces of data detected by a plurality of X-ray detector elements are previously measured as a pieces of compensation data while shifting the X-focal point to different positions. Compensation data corresponding to the actual position of the X-ray focal point, which shifts according to the thermal state of the X-ray tube unit, is selected to correct detect data obtained for a subject under examination, permitting optimum compensation of variations in sensitivity among the X-ray detector elements for any position of the X-ray focal point, thereby preventing a ring-like artifact from being produced on a tomography image.

27 Claims, 10 Drawing Sheets

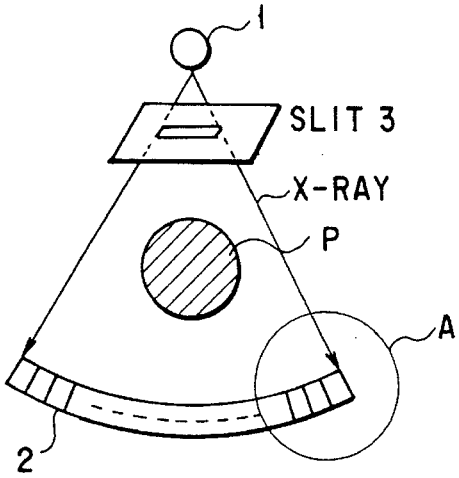
(PRIOR ART)
FIG. 1
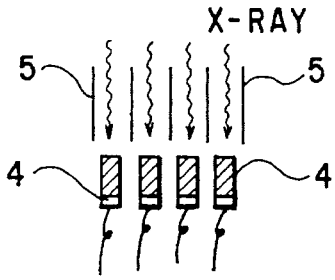
(PRIOR ART)
FIG. 2
(PRIOR ART)
FIG. 3
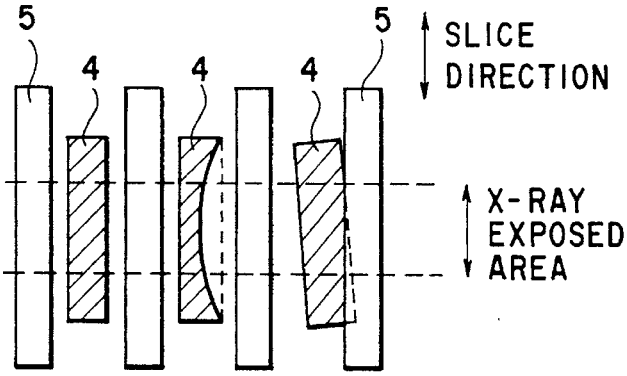
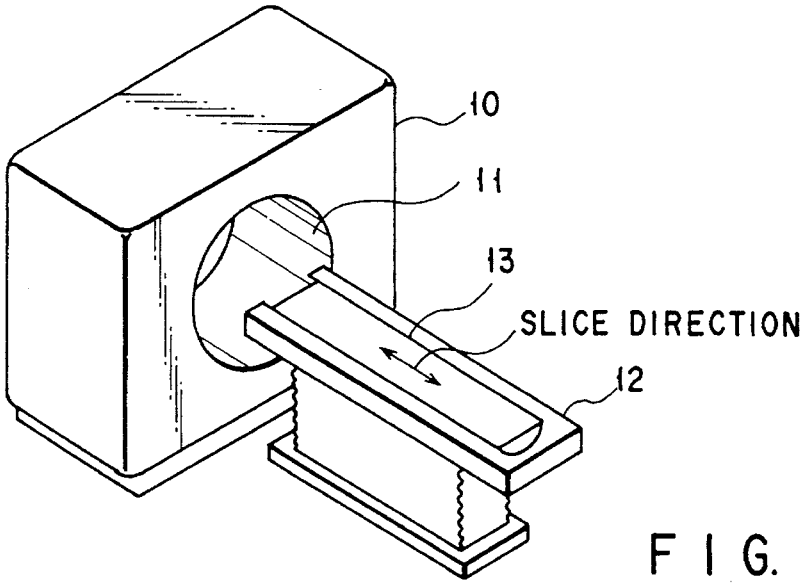
FIG. 4

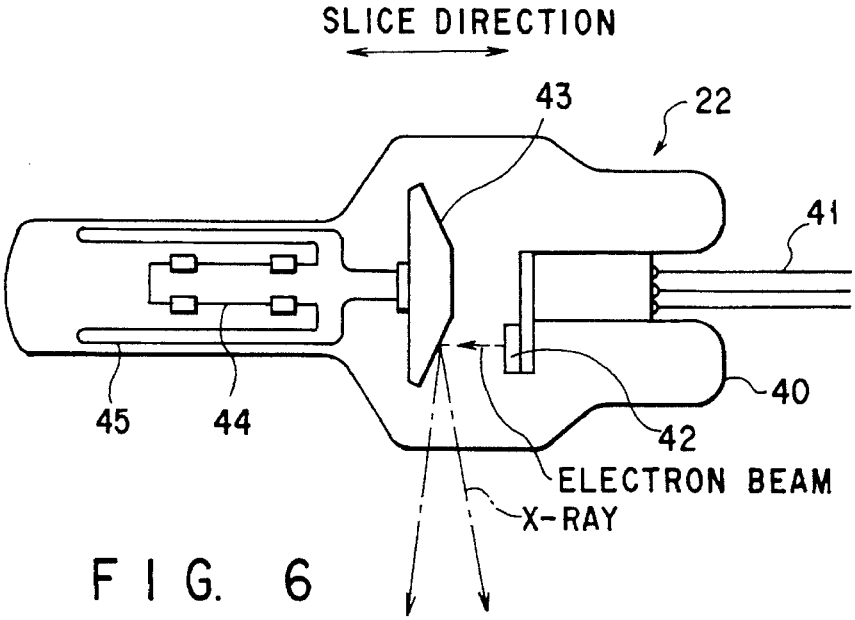
FIG. 6
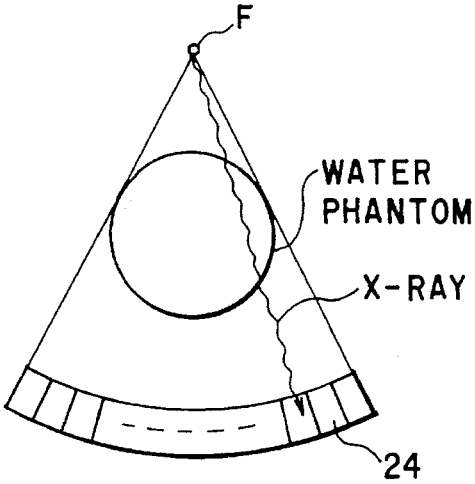
FIG. 7
FIG. 8
| FOCAL POINT POSITION / CHANNEL | F1 | F2 | . . . | Fm |
|---|---|---|---|---|
| CHANNEL 1 | R11 | R12 | | R1m |
| CHANNEL 2 | R21 | R22 | | R2m |
| ⋮ | | | | |
| CHANNEL n | Rn1 | Rn2 | | Rnm |

X-RAY COMPUTERIZED TOMOGRAPHY APPARATUS

This application is a continuation, of application Ser. No. 08/160,727, filed Dec. 2, 1993, now abandoned.

BACKGROUND OF THE INVENTION

1. Field of the Invention

The present invention relates to an X-ray computerized tomography apparatus which compensates for variations in sensitivity among channels.

2. Description of the Related Art

An X-ray computerized tomography apparatus (hereinafter abbreviated to an X-ray CT apparatus) directs X-rays to a subject under examination from a plurality of different directions to thereby acquire a plurality of pieces of projection data in different transmission paths, performs reconstruction processing on those projection data to thereby compute a CT value corresponding to the X-ray absorption of each portion in a plane section of the subject, and produce a reconstructed image (tomogram) of the plane section by forming these CT values into a two-dimensional array.

FIG. 1 schematically illustrates the internal structure of a gantry that is a main component of an X rays CT apparatus of the third generation. X-rays emitted from an X-ray tube 1 are directed onto a subject under examination P through a slit 3. A multichannel X-ray detector 2 is placed so that it is opposed to the X-ray tube 1 with the subject P interposed therebetween. Rotating mechanisms not shown cause the X-ray tube 1 and the X-ray detector 2 to rotate around the subject P. X-rays emitted from the X-ray tube 1 are partly absorbed by tissues of the subject P and the absorption of the X-rays is detected as projection data by the X-ray detector 2. The emission and detection of X-rays are repeated each time the X-ray tube and the detector are rotated through a small angle. Thereby, projection data are detected from many directions. These projection data are fed into an image reconstructing unit via a data collector. The image reconstructing unit performs reconstruction processing on the projection data from various directions to obtain CT values of various portions of a plane section of the subject. These CT values, combined with position data, are sent to an image display device or image storage device.

FIG. 2 is an enlarged view of the A portion of the X-ray detector of FIG. 1. The X-ray detector 2, when it is of a solid-state type, consists of an array of a plurality of X-ray detector elements 4 which are each composed of a scintillator and a photodiode and which are arranged along circumference with the center at the X-ray focal point. The detector elements 4 are separated by collimators 5. FIG. 3 is a view of the X-ray detector 2 seen from the X-ray tube 1. Manufacturing errors of processing and assembly and nonuniformity of materials used will produce variations in sensitivity among X-ray detector elements (channels). In general, these variations are compensated for by correcting output values of the X-ray detector elements obtained when a subject under examination is actually imaged with output values of the detector elements obtained when a water phantom is imaged, i.e., calibration data.

Nowadays the most commonly used type of an X-ray tube is a rotation anode X-ray tube. In this type of X-ray tube, X rays are produced when a rotation target electrode (anode), which is made of tungsten or the like, is bombarded with a beam of electrons emitted from a cathode. This point of bombardment is the focal point of X rays. When the target is made of tungsten, the efficiency of energy conversion from electron beam to X rays is less than 1%, and most of the remainder of the energy is converted to heat energy. The rotation anode X-ray tube was developed for higher heat resistance. Part of the heat generated in the target is radiated through a shaft that mounts the target rotatably.

The repetition of X-ray emission increases stored quantity of heat in the target and the temperature of the shaft increases correspondingly. As a result, the shaft expands and the X-ray focal point shifts in the direction of slice accordingly. It is common that the shaft is provided in parallel with the direction of slice. As was mentioned in connection with FIG. 3, the manufacturing errors of processing and assembly and the nonuniformity of materials produce variations in sensitivity among channels, which will change with the shift of the X-ray focal point. High-sensitivity solid-state X-ray detectors that are the most used type nowadays will follow changes of the variations faithfully.

The above-mentioned calibration data are those obtained under a fixed focal point. Thus, the conventional correcting method cannot compensate for changes of variations in sensitivity among channels due to the shift of the X-ray focal point, which will produce a ring-like artifact on a tomography image.

To remedy such a problem, a method is disclosed in U.S. Pat. No. 991,189 which moves the slit according to the shift of the X-ray focal point. However, this method is not preferable because the slice plane is caused to shift.

SUMMARY OF THE INVENTION

It is therefore an object of the present invention to provide an X-ray CT apparatus which permits variations in sensitivity among channels caused by the shift of an X-ray focal point to be compensated for to thereby prevent a ring-like artifact from being produced on a wanted tomography image.

According to the present invention there is provided an X-ray computerized tomography apparatus comprising: an X-ray tube unit for emitting X-rays from its X-ray focal point; X-ray detector means opposed to the X-ray tube unit with a subject under examination interposed therebetween and comprising an array of a plurality of X-ray detector elements for detecting X rays transmitted through the subject; position measuring means for measuring the position of the X-ray focal point which shifts according to the thermal state of the X-ray tube unit; storage means for storing, as a plurality of pieces of compensation data, a plurality of pieces of detect data previously obtained by the plurality of X-ray detector elements with a water phantom interposed between the X-ray tube unit and the X-ray detector means in place of a subject under examination and the X-ray focal point shifted to different positions; compensation means for compensating for variations in sensitivity among the X-ray detector elements by subtracting compensation data obtained by each of the X-ray detector elements from detector data obtained by the same X-ray detector element for the subject, the compensation data and the detector data being obtained when the X-ray focal point is located in the same position detected by the position measuring means; and reconstruction means for reconstructing a tomography image from output data from the compensation means.

According to the present invention, a water phantom is interposed between an X-ray tube unit and an X-ray detector in place of a subject under examination and a plurality of pieces of data detected by a plurality of X-ray detector elements are previously measured as pieces of compensation data while shifting the X-focal point to different positions. Compensation data corresponding to the actual position of the X-ray focal point, which shifts according to the thermal state of the X-ray tube unit, is selected to correct detect data obtained for a subject under examination, permitting optimum compensation of variations in sensitivity among the X-ray detector elements for any position of the X-ray focal point, thereby preventing a ring-like artifact from being produced on a tomography image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 1 is a schematic illustration of the internal structure of the gantry of a conventional X-ray CT apparatus of the third generation;

FIG. 2 is an enlarged view of that part of the X-ray detector of FIG. 1 which is enclosed with circle A;

FIG. 3 is a schematic illustration of part of the X-ray detector of FIG. 1 seen from the X-ray tube side;

FIG. 4 is a perspective view of the structure of an X-ray CT apparatus;

FIG. 6 illustrates the internal structure of the X-ray tube of FIG. 5;

FIG. 7 is a diagrammatic representation of the determination of calibration data;

FIG. 8 shows an example of calibration data;

DETAILED DESCRIPTION OF THE PREFERRED EMBODIMENTS

Referring now to FIG. 4, there are shown in perspective a gantry and an examination couch which are main structures of an X-ray CT apparatus. The gantry 10 has an aperture 11 in its central portion. Though not shown, into the gantry 10 an X-ray tube and a multichannel X-ray detector are built so that they are opposed to each other while rotating with the aperture interposed therebetween. The couch 12 supports a top board 13 slidably along the slice direction. A subject under examination is laid down on the top board 13 and, at examination time, the top board slides to allow the subject to have access to the aperture 11.

Figure 5:
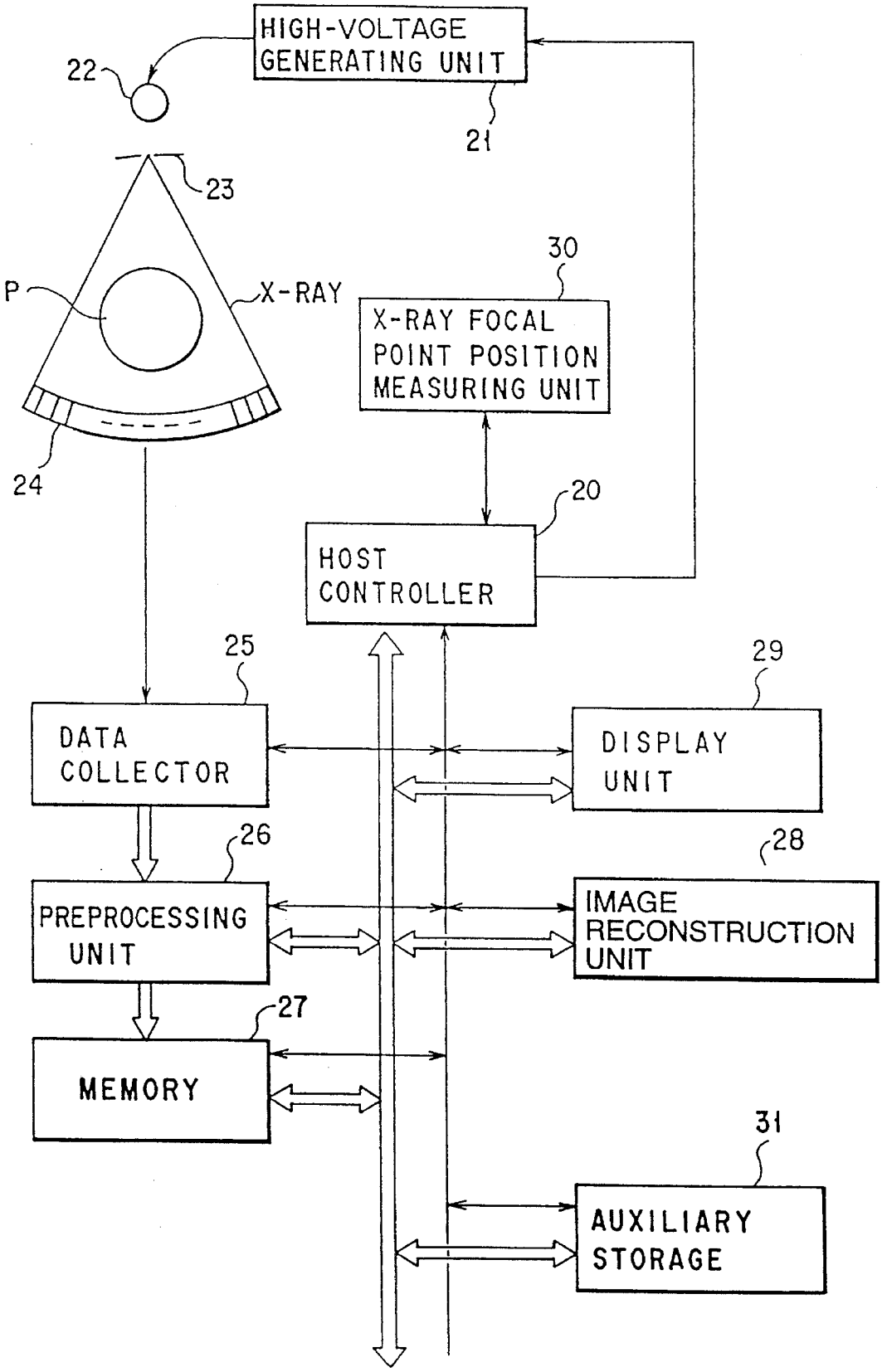
FIG. 5 is a block diagram of an X-ray CT apparatus according to a first embodiment of the present invention.

FIG. 5 illustrates, in block form, the whole arrangement of an X-ray CT apparatus according to a first embodiment of the present invention. A high-voltage generating unit 21 applies a high voltage to a rotation anode X-ray tube 22 in response to a control signal from a host controller 20. FIG. 6 is a sectional view of the rotation anode X-ray tube 22. To the inside of an evacuated glass bulb 40 is fixedly mounted a cathode 42 that is connected to the high-voltage generating unit 21 by signal lines 41. When the cathode 42 is supplied with a high voltage, a beam of electrons is emitted to a target 43 formed into the shape of a cone. The position at which the target 43 is bombarded with a beam of electrons is the focal point of X rays, from which X rays are emitted. The target 43 is attached to the tip of a rotatably mounted shaft 44. A rotor 45, serving as a permanent magnet, is mounted to the shaft 44 along the inner wall of the glass bulb 40. Though not shown, a stator, serving as a rotor driving coil, is fixedly mounted around the outer wall of the glass bulb 40 so that it is opposed to the rotor 45. The rotor 45 and the stator thus forms an induction motor.

Returning now to FIG. 5, X rays emitted from the X-ray tube 22 are limited by a slit 23 to have a predetermined angle of broadening, so that they are directed onto a subject P under examination as a fan beam of X-rays. The X-rays, which are partly absorbed by the subject P, are converted to currents by the multichannel X-ray detector 24 opposed to the X-ray tube 22. A current value corresponds to the energy of X rays after transmission through the subject P, in other words, the quantity of X rays absorbed on each transmission path. This current signal is generally called projection data. The X-ray tube 22 and the X-ray detector 24 make one rotation around the subject P by means of rotating mechanisms not shown. During this rotation, the emission and detection of X-rays are performed at every angular step, i.e., each time the X-ray tube and the detector rotate through a predetermined small angle. Thereby, multidirectional projection data are obtained. A current signal is amplified, converted to a voltage signal,, converted to a digital signal, and then transferred to a preprocessing unit 26 by a data collector 25.

Projection data from the data collector 25 is subjected to offset compensation, reference compensation, and sensitivity compensation in the preprocessing unit 26. In amplifiers in the data collector 25, their outputs indicate non-zero values even when X rays are not emitted. This is due mainly to thermal noise. This phenomenon is called offset. In the preprocessing unit 26, projection data are compensated on the basis of offset levels which have been measured and stored in an internal memory previously (offset compensation). The offset-compensated projection data are then subjected to logarithmic conversion. Logarithmic values of outputs of X rays which do not undergo attenuation at all are subtracted from the logarithmic-converted projection data. This subtraction process is called reference compensation. The sensitivity compensation is a process to subtract calibration data from the projection data which have been subjected to the offset compensation and reference compensation, thereby compensating for variations in sensitivity among channels (i.e., the channels are made uniform in sensitivity).

An auxiliary storage device 31 stores sensitivity compensating calibration data previously measured for each channel under a plurality of different focal points. At actual examination time, all the calibration data are sent to the preprocessing unit 26 and stored in its internal memory. The preprocessing unit 26 selects calibration data corresponding to the position of the X-ray focal point measured by the X-ray focal point position measuring unit 30 and then subtracts the calibration data for each channel from projection data for the same channel. This process permits variations in sensitivity among channels to be compensated for.

The sensitivity-compensated projection data is transferred to an image reconstruction processing unit 28 via a memory 27. The image reconstruction processing unit performs reconstruction processing, such as convolution, on the multidirectional projection data to compute a CT value for each point. Each CT value, combined with position data, is sent to an image display unit 29, so that a tomography image representing a two-dimensional distribution of CT values is displayed on the screen of a display (not shown).

The above-described calibration data can be obtained in the following manner. As shown in FIG. 7, a water phantom the size of the X-ray emission area is set in the center of that area. Next, as is the case with actual imaging, the emission and detection of X-rays are performed, and then the intensity of X-rays incident on each of the detector elements of the multichannel X-ray detector 24 is measured. The projection data thus obtained are subjected to the offset compensation, logarithmic conversion, and reference compensation in sequence and then transferred via the memory device 18 to the auxiliary storage device 21 where they are stored together with the current position of the X-ray focal point measured by the measuring unit 30. This operation is repeated until the temperature inside the X-ray tube rises from room temperature to a critical temperature. Thereby, calibration data is obtained for each channel with the X-ray focal point shifted to different positions.

Figure 9:
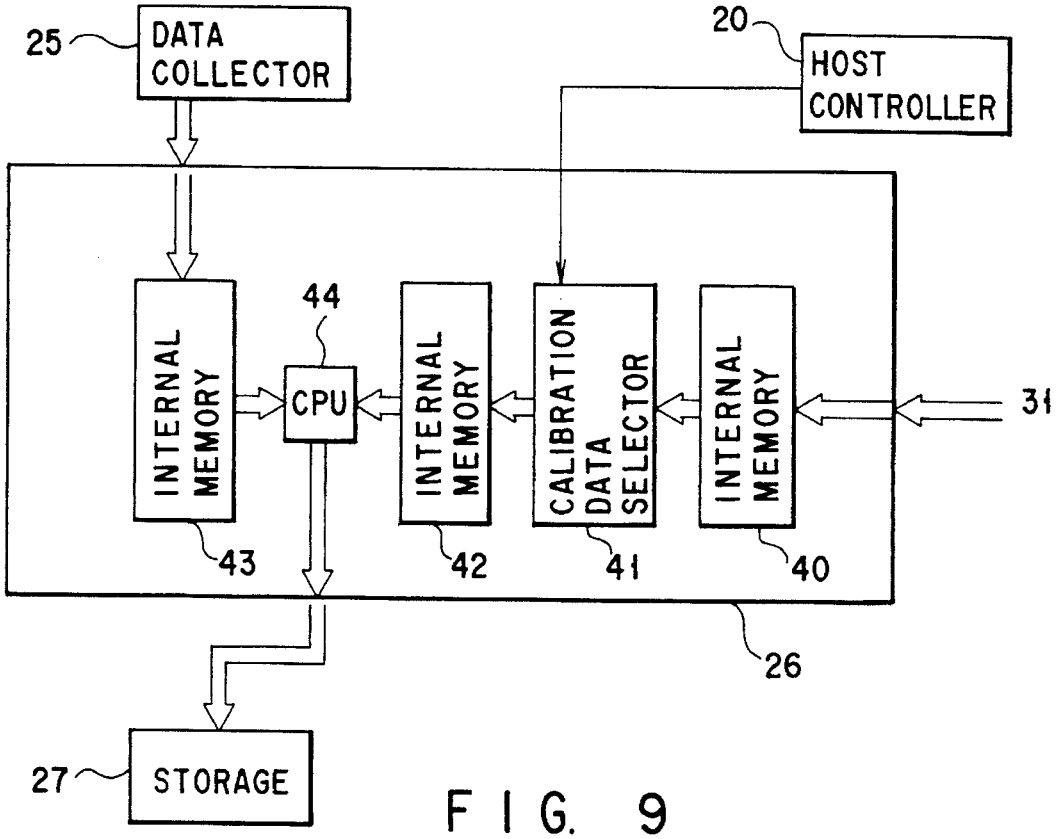
FIG. 9 is a block diagram of the preprocessing unit of FIG. 5.

FIG. 9 shows, in block form, main portions of the preprocessing unit 26 which are adapted for sensitivity compensation. At actual imaging time, all the calibration data are read from the auxiliary storage device 31 and then transferred to an internal memory 40 in the preprocessing unit 26. On the other hand, projection data collected by the data collector 25 are stored in an internal memory 43 in the preprocessing unit 26 after they have been subjected to the offset compensation and the reference compensation. In addition, the current position of the X-ray focal point is measured by the focal point measuring unit 30. The host controller 20 transfers the X-ray focal point position information to a calibration data selector 41. In response to the focal point position information the calibration data selector 41 selectively reads calibration data corresponding to the current position of the X-ray focal point from the internal memory 40 and then transfers them to the internal memory 42. In the absence of calibration data that correspond to the current position of the X-ray focal point, the calibration data selector 41 creates calibration data for the current X-ray focal point position from stored calibration data for two positions between which the current X-ray focal point locates by means of interpolation. On the other hand, where the X-ray focal point positions are set at close intervals in measuring calibration data, the calibration data selector 41 may use calibration data for a set focal point position closest to the current focal point position as it is for sensitivity compensation.

The calibration data for the respective channels are sent to a CPU 44 via the internal memory 42. The CPU 44 subtracts calibration data from the projection data from the internal memory 43 for each channel. Thereby, the projection data for the respective channels are made uniform in sensitivity. The results of the subtraction processing are output to the storage device 27.

The X-ray focal point position measuring unit 30 is arranged to measure the current position of the X-ray focal point. The present embodiment provides three types of X-ray focal point position measuring units whose arrangements vary according to different measuring principles. According to the first principle, the position of the X-ray focal point is measured on the basis of the position of irradiation with X rays emitted from the X-ray tube 221through the slit 23. According to the second principle, a position is selected for the present X-ray focal point on the basis of the history of the X-ray emission. According to the third principle., the temperature within the X-ray tube is measured, and the position of the present X-ray focal point is determined from the temperature measured.

Figure 10:
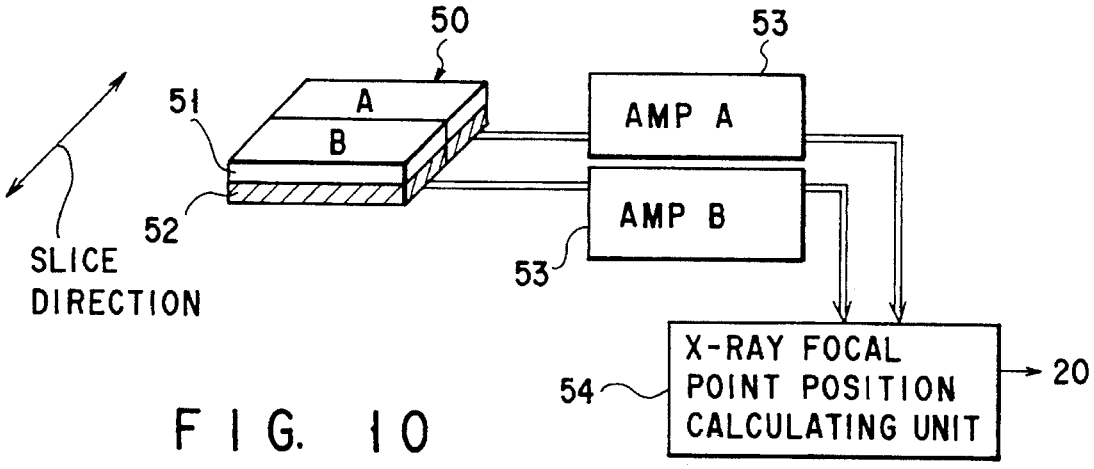
FIG. 10 illustrates the arrangement of the X-ray focal point position measuring unit of FIG. 5 according to a first principle.
Figure 11:
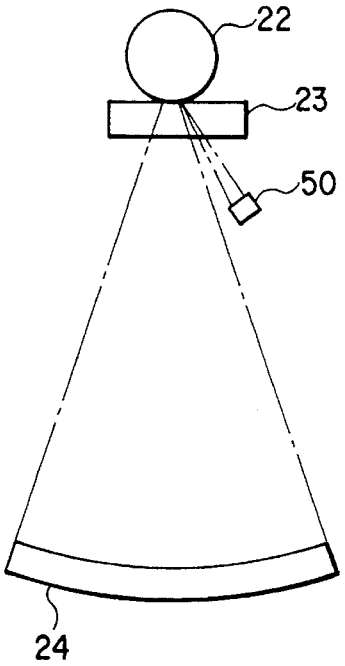
FIG. 11 is a view of the arrangement of the sensor of FIG. 10 seen from the slice direction.
Figure 12:
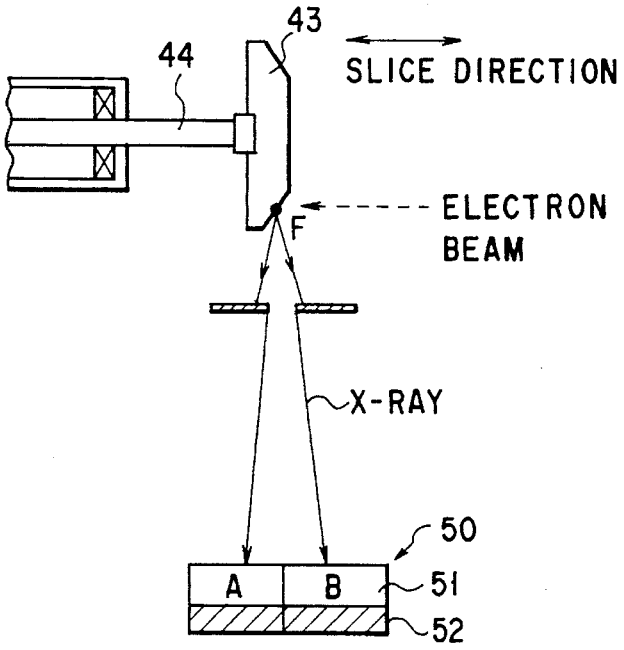
FIG. 12 is a view of the arrangement of the sensor of FIG. 10 seen from the direction perpendicular to the slice direction.
Figure 13:
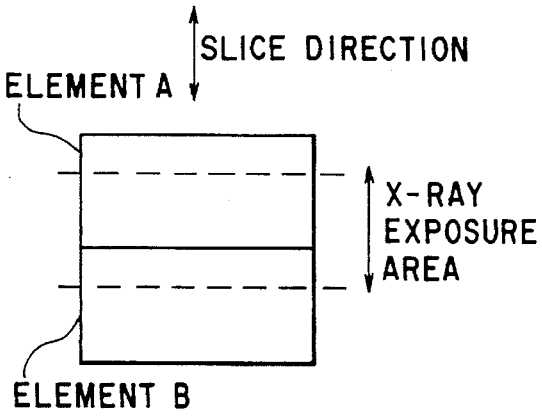
FIG. 13 is a view of the sensor of FIG. 10 seen from the X-ray tube side.

First, the X-ray focal point position measuring unit 30 based on the first principle will be described. As shown in FIG. 10, the measuring unit 30 has a sensor 50 composed of a pair of X-ray detecting elements A and B juxtaposed to each other. Each of the elements A and B consists of a scintillator 51 for converting incoming X-rays into light and a photodiode 52 for converting light into current, the latter being disposed on the back of the former. The sensor 50 is placed as shown in FIGS. 11 and 12. That is, part of X-rays emitted from the X-ray tube 22 through the slit 23 are directed onto the X-ray detecting elements A and B juxtaposed in the slice direction. FIG. 13 is a view of the sensor 50 seen from the X-ray tube side.

Figure 14:
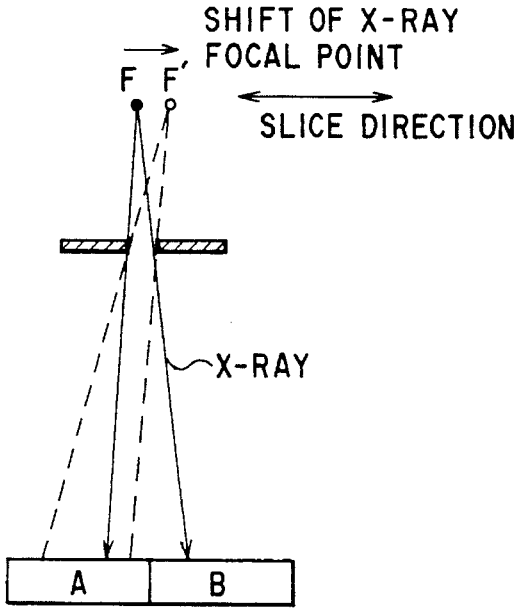
FIG. 14 illustrates a change of the X-ray exposed area of the sensor with a shift of the X-ray focal point.
Figure 15:
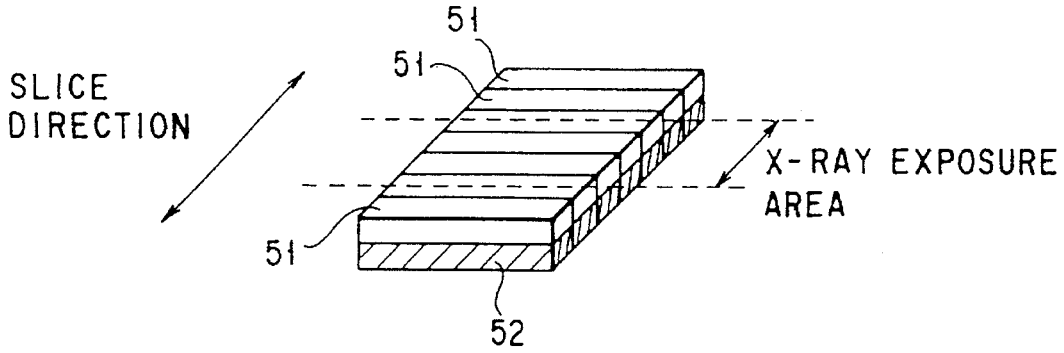
FIG. 15 illustrates a modification of the sensor.

A current Signal output from each of the X-ray detecting elements-A and B is fed into an X-ray focal point position-calculating unit 54 via a respective one of amplifiers 53. The two current signals fed into the calculating unit 54 are converted into respective voltage signals and then into respective digital signals. The ratio of the two-digital signals is calculated after a difference in sensitivity between the elements A and B has been compensated for. The ratio corresponds to the ratio of areas of those portions of the elements A and B which are irradiated with X-rays. For example, when the sensor 50 is placed so that the sensor elements A and B are equally irradiated, as indicated by solid lines in FIG. 14, with X-rays emitted from an X-ray focal point F when the inside of the X-ray tube has the room temperature, those portions of the elements A and B which are irradiated with X-rays emitted from an X-ray focal point F' at a high temperature will differ in area. Thus, the X-ray focal point position calculating unit 54 can calculate the current position of the X-ray focal point on the basis of that ratio. Note that, instead of using two sensor elements, the sensor 50 may comprise three or more sensor elements which are juxtaposed to one another in the slice direction as shown in FIG. 15. In this case, there is an advantage in that the X-ray focal point position can be calculated with higher accuracy.

Figure 17:
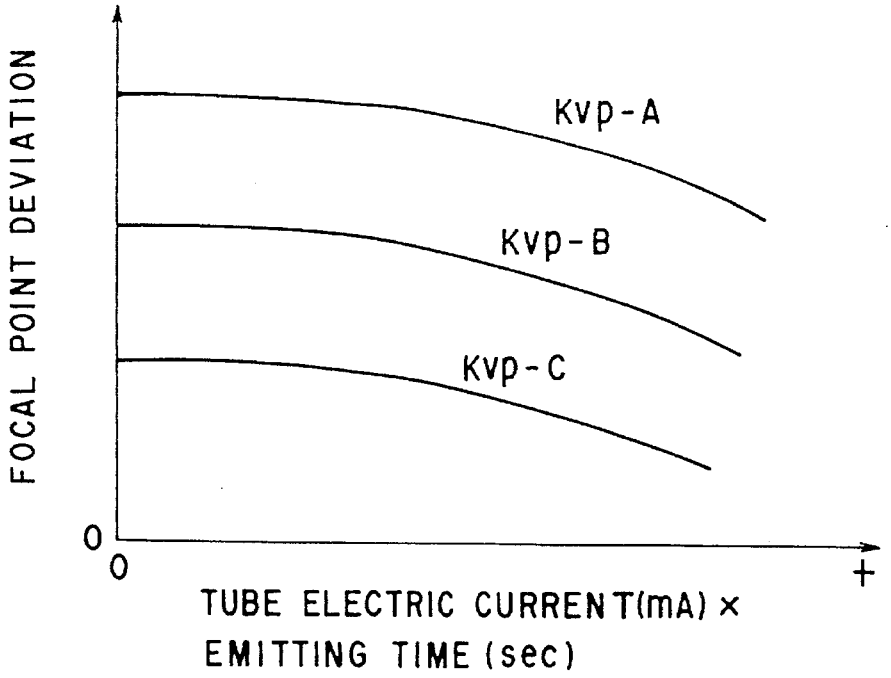
FIG. 17 is a diagram showing the distance the X-ray focal point moves in accordance with the tube voltage, the tube current and the X-ray emission period.
Figure 18:
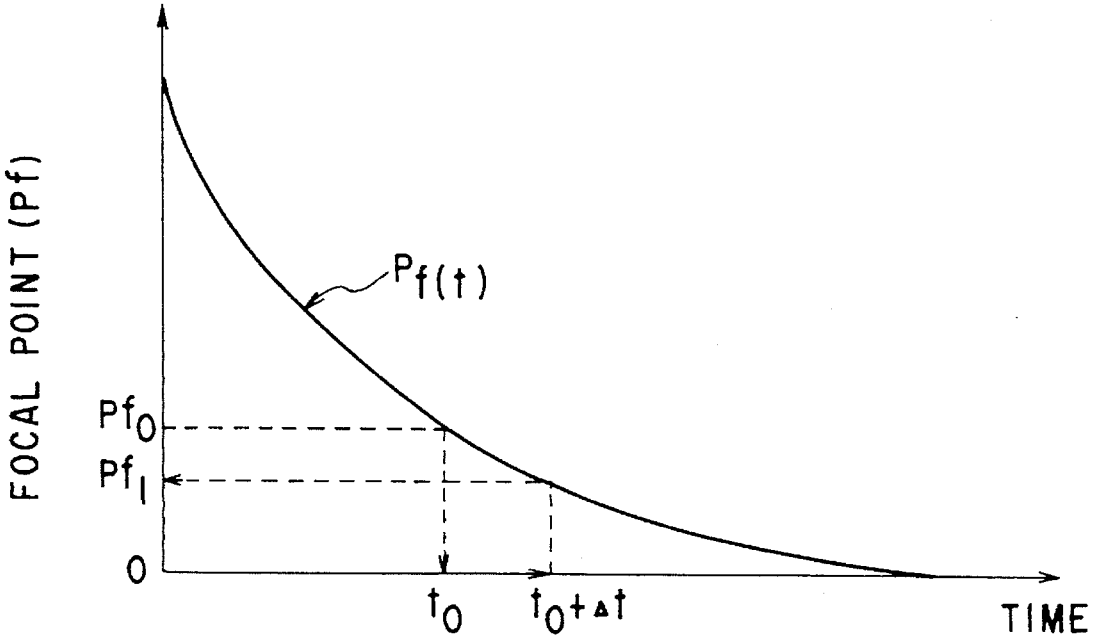
FIG. 18 is a diagram illustrating the changes in the position of the X-ray focal point, which occurs as the temperature within the tube falls with time.

The X-ray focal point position measuring unit 30, which is based on the second principle, will now be described. FIG. 17 shows how the X-ray focal point moves at three different tube voltages kvp-A, kvp-B, kvp-C with changes in the product of the tube current (mA) and the X-ray emission period (sec); the distance the point moves is plotted on the ordinate, while the product of the current and the period is plotted on the abscissa. FIG. 18 shows the relationship between the distance and the product of the current and period, which has been determined by actually measuring various distances the point moves at different tube currents, different X-ray emission periods, and the three tube voltages. This relationship is stored in a memory incorporated in the measuring unit 30.

Figure 16:
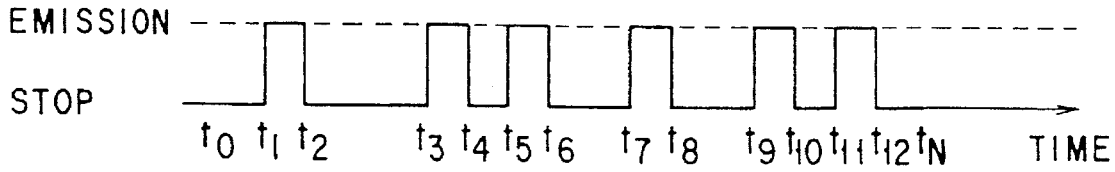
FIG. 16 illustrates an example of a history of X-ray emissions which is dealt with in accordance with a second principle.

The measuring unit 30 monitors the control signals being supplied from the host controller 20 to the high-voltage generating unit 21, and determines the history of X-ray emission (FIG. 16). This history which covers the period between the last fall of the temperature in the tube (upon lapse of four hours from the termination of previous X-ray emission) and the present time (i.e., the time immediately before the start of X-ray emission). The history is defined by emission information consisting of the tube voltage, the tube current, the emission timing and the emission period, and emission-interrupt information consisting of the time of terminating the emission and the time of resuming the emission.

Using the emission information and the emission-interrupt information, both included in the history, the measuring unit 30 infers two positions the X-ray focal point should assume immediately before the present X-ray emission—from the changes (FIG. 17) in the distance the X-ray focal point moves and the relationship (FIG. 18) between the distance and the product of the current and the emission period. The position the X-ray focal point should take during the present X-ray emission is inferred by calculating the distance the X-ray focal point moves as the X-ray emission proceeds, and by adding the distance, thus calculated, to the inferred distance which the point has moved immediately before the present X-ray emission. The data representing the position, which the point assumes during the present X-ray emission and which has just been inferred, is supplied to the host computer 20.

Figure 19:
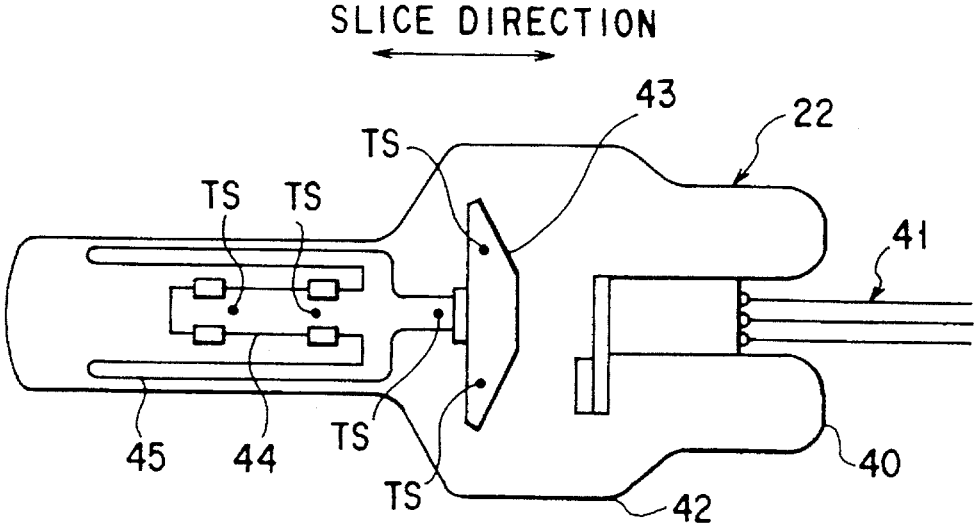
FIG. 19 illustrates the interior of an X-ray tube in which temperature sensors involved in the X-ray focal point position measuring unit of FIG. 5 based on a third principle are placed in position.

The X-ray focal point position measuring unit 30, which is based on the third principle, will now be described. As shown in FIG. 19, this unit 30 comprises a memory (not shown) and a plurality of temperature sensors TS. The temperature sensors TS are located at various positions within an X-ray tube 22. Each sensor TS has a shaft 44, a target 43 and a few other portions. The portions of each sensor TS, including the shaft 44 and target 43, have specific thermal expansion coefficients, which are stored in the memory. When the temperature in the tube 22 is at room value (that is, when the interior of the tube 22 is completely cooled), the each sensor TS has an overall length L0 (i.e., measured from the free end of the shaft 44 to the tip of the target 43), which is given:

$$L0=\sum_j lj$$

where $l_j$ is the length any portion of each sensor TS has at room temperature.

The length $L_j$ which any portion of the sensor TS has during the X-ray emission is:

$$L_j=\sum_j l_j\{1+kj\times(Tj-T0)\}$$

where T0 is the time when the interior of the tube 22 is at room temperature and $T_j$ is the time lapsed from the time T0.

Hence, the distance Δ the X-ray focal point has moved from the reference position is represented as:

$$\Delta=L-L0=\Sigma l_j\times kj\times(Tj-TO)$$

The distance Δ is added to the data representing the reference position, and the present position of the X-ray focal point is inferred from the resultant sum. The data showing the present position, thus inferred, is supplied to the host controller 20.

Hereinafter, the measurement of calibration data and the sensitivity compensation will be described individually. First, the measurement of calibration data is described. As shown in FIG. 7, a water phantom the size of the imaging area is set in the center of the imaging area. Next, as in the case of actual imaging, the emission and detection of X-rays are performed, and calibration data is measured for each channel and for each X-ray focal point position. In this case, it is desirable that the measurement of calibration data be made for each of X-ray focal point positions which are spaced regularly at intervals of a distance of the order of several tens to several hundreds of micrometers. Thus, the host controller 20 outputs a data collection instruction to the data collector 25 while monitoring the X-ray focal point position measured by the position measuring unit 30. The water phantom projection data collected when the X-ray focal point has reached an intended position is subjected to the offset compensation and the reference compensation in the preprocessing unit 26 and then stored, as calibration data, into the auxiliary storage device 31 together with the corresponding X-ray focal point position information. This process is repeated for each of all of the intended X-ray focal point positions. Thus, multichannel calibration data for each of a plurality of X-ray focal point positions is stored into the auxiliary storage device 31. In order to follow the time-varying sensitivity of the X-ray detecting elements, it is desired that the process be repeated at regular intervals so as to update the calibration data.

Next, the sensitivity compensation will be described. At imaging time, all the calibration data are read from the auxiliary storage device 31 and then stored into the internal memory 40 of the preprocessing unit 26. Projection data collected by the data collector 25 is subjected to the offset compensation, logarithmic conversion and reference compensation in sequence and then stored into the internal memory 43. The position the X-ray focal point takes when that projection data is collected is measured by the position measuring unit 30, is displayed by the image display unit 29 and then is sent to the calibration data selector 41 via the host controller 20. The calibration data selector 41 reads multichannel calibration data corresponding to the measured X-ray focal point position from the internal memory 40 and then stores it into the internal memory 42. If calibration data has not been measured which corresponds to the current position of the X-ray focal point measured by the position measuring unit 30, it may be interpolated from measured calibration data which correspond to two positions of the X-ray focal point between which the current X-ray focal point position is located. Alternatively, measured calibration data which corresponds to an X-ray focal point position closest to the current focal point position may be read from the internal memory 40 and stored into the internal memory 42.

Projection data and calibration data are respectively read from the internal memory 43 and the internal memory 42 into the CPU 44 on a channel-by-channel basis, in synchronism with each other. The CPU 44 subtracts the calibration data from the projection data on a channel-by-channel basis and then outputs the results to the image reconstruction unit 28 via the storage device 27 as sensitivity-compensated multidirectional projection data. Thereby, multidirectional projection data free of focal-point-position-dependent variations in sensitivity is gathered in the image reconstruction unit 28.

The image reconstruction unit 28 performs a predetermined reconstruction process on the multidirectional projection data to thereby compute CT values of various portions of an imaging region. The CT values, combined with corresponding position information, are output to the image display unit 29 as tomography image data. This image data is also sent to and stored in the auxiliary storage device 31.

According to the present invention, as described above, calibration data is previously measured for each of different X-ray focal point positions and then stored, and, at imaging time, projection data is subjected to sensitivity compensation using calibration data corresponding to the actually measured X-ray focal point position. Therefore, even when variations in sensitivity among channels due to the shift of the X-ray focal point are made significant by the use of a high-sensitivity solid-state detector as the X-ray detector, they can be compensated for so that the channels are made uniform in sensitivity, thereby solving the problem of a ring-like artifact being produced on a tomography image.

Although the present embodiment was described as using a solid-state type as the X-ray detector, this is not restrictive. Of course, a conventional ionization chamber type X-ray detector utilizing Xe gas may be used.

Figure 20:
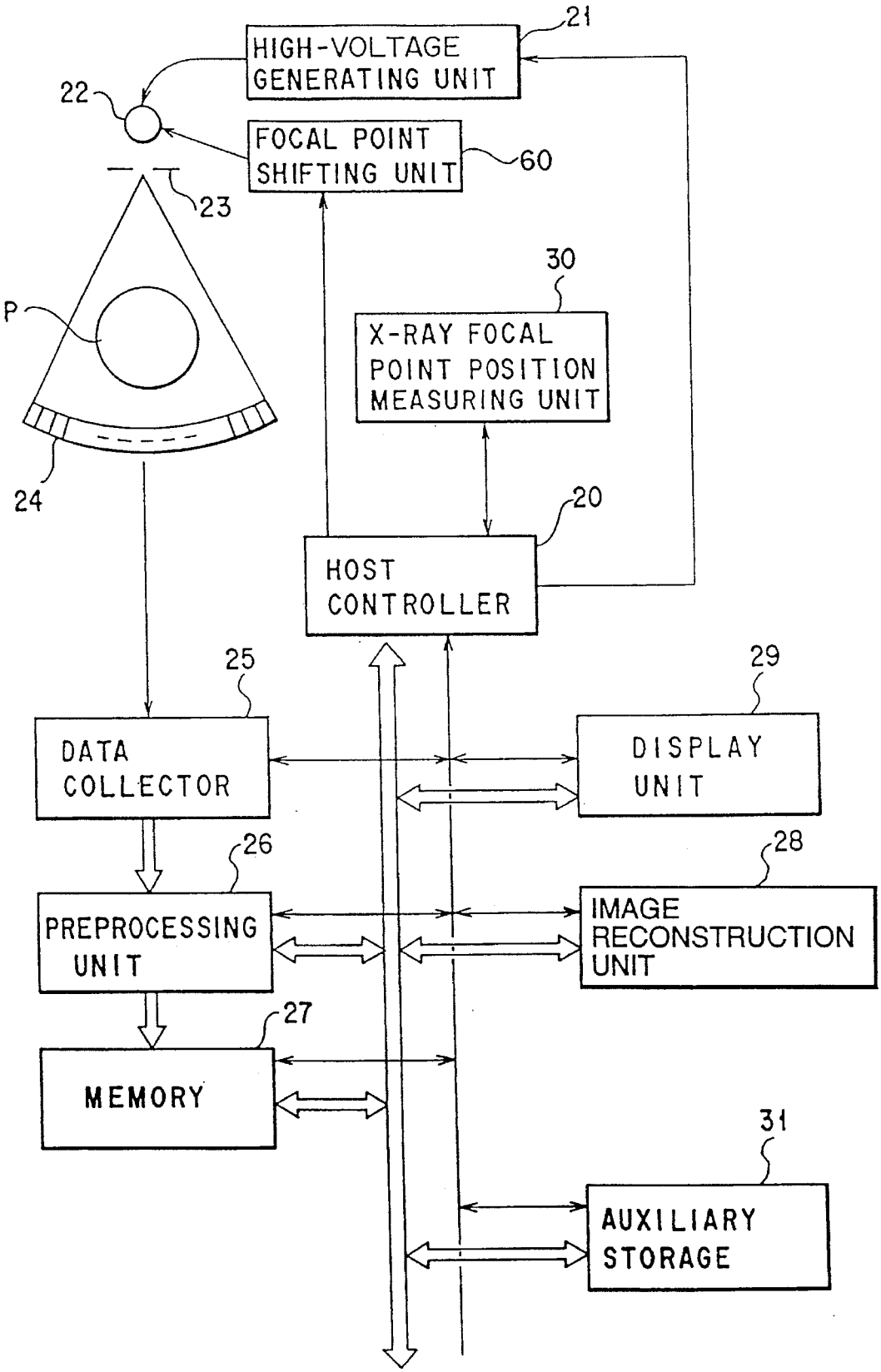
FIG. 20 is a block diagram of an X-ray CT apparatus according to a second embodiment of the present invention.

A second embodiment of the present invention will be described hereinafter. FIG. 20 is a block diagram of an X-ray CT apparatus according to the second embodiment, in which like reference numerals are used to denote corresponding parts to those in FIG. 5. Although, in the first embodiment, the sensitivity compensation associated with the shift of the X-ray focal point is made by subtracting calibration data from detected projection data, the second embodiment is characterized by returning the shifted X-ray focal point to the reference position physically. Thus, the auxiliary storage device 31 simply stores only calibration data corresponding to the reference position. The measurement of the position of the X-ray focal point is made by the X-ray focal point position measuring unit 30 in the same manner as the first embodiment.

Information about the position of the X-ray focal point measured by the position measuring unit 30 is sent to the host controller 20, which measures the distance between the current position of the X-ray focal point and the reference position and a direction in which the focal point has been shifted. The host controller 20 controls a focal point shifting unit 60 so as to shift the X-ray focal point in the opposite direction to that direction and by the same distance. The focal point shifting unit 60 is arranged to shift the X-ray focal point. The present embodiment provides two types of arrangements according to different principles. The first principle is to shift the X-ray tube 22 itself mechanically, while the second principle is to change the position of that point of the target (anode) which is bombarded with X-rays emitted from the cathode of the X-ray tube 22 to thereby shift the X-ray focal point.

Figure 21:
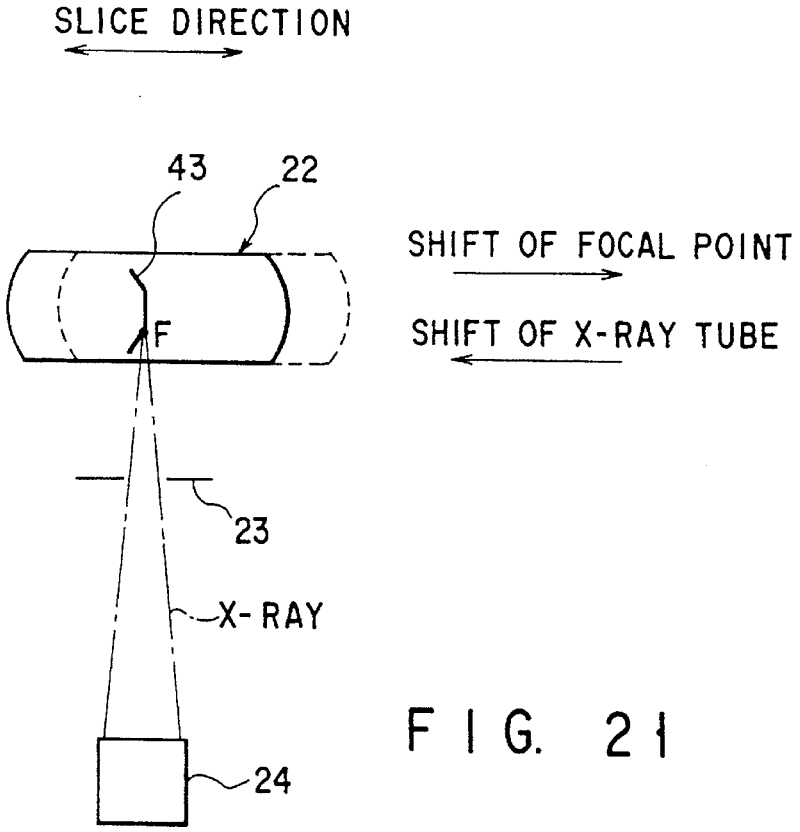
FIG. 21 illustrates the shift of the X-ray focal point by the focal point shifting unit of FIG. 20 based on a first principle.

The first principle will be described hereinafter. The above-mentioned reference position is the position of the X-ray focal point when the inside of the X-ray tube 22 has the room temperature. The arrangement of the X-ray tube 22, the slit 23, and the X-ray detector 24 is determined according to the reference position. The X-ray tube is supported movably along the slice direction by X-ray tube shifting and supporting mechanisms which, though not shown, are included in the focal point shifting unit 60. The slit 23 and the X-ray detector 24 are fixed in that arrangement. That is, the X-ray tube 22 can be moved relative to the slit 23 and the X-ray detector 24. FIG. 21 illustrates the first principle. In this figure, dotted line indicates the X-ray tube 22 when the focal point is placed in the reference position, while solid line indicates the X-ray tube after it has been shifted. Controlled by the host controller 20, the X-ray tube shifting and supporting mechanisms shift the X-ray tube 22 in the direction opposite to that in which it has been shifted and by an equal amount. As a result, the X-ray focal point is returned to the reference position. Thus, the positional relationship among the X-focal point, the slit 23, and the X-ray detector 24 remains unchanged, so that X-rays are equally directed onto each of the detector elements of the X-ray detector 24 all the time.

Figure 22:
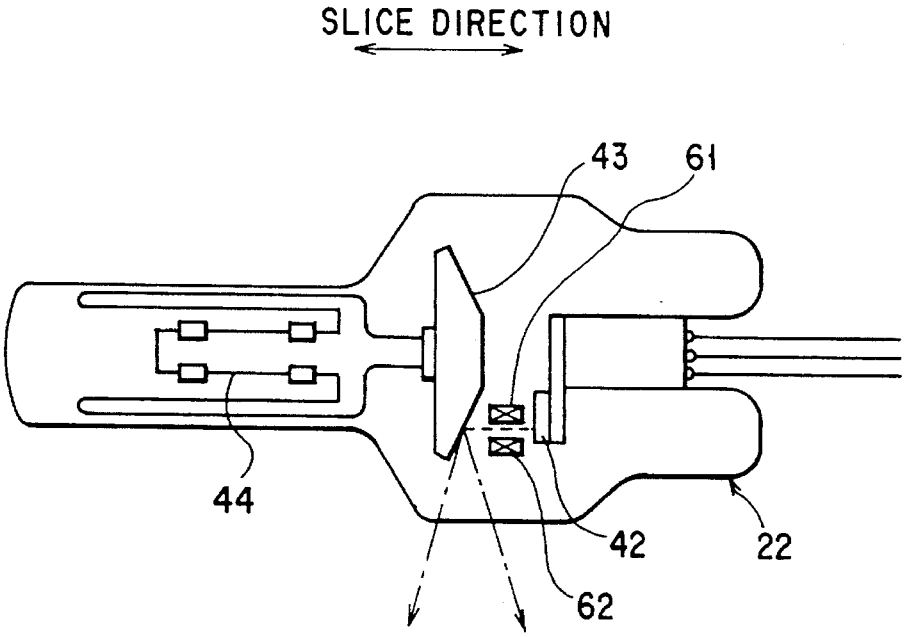
FIG. 22 illustrates the interior of an X-ray tube in which deflection coils involved in the focal point shifting unit of FIG. 20 based on a second principle are placed in position.
Figure 23:
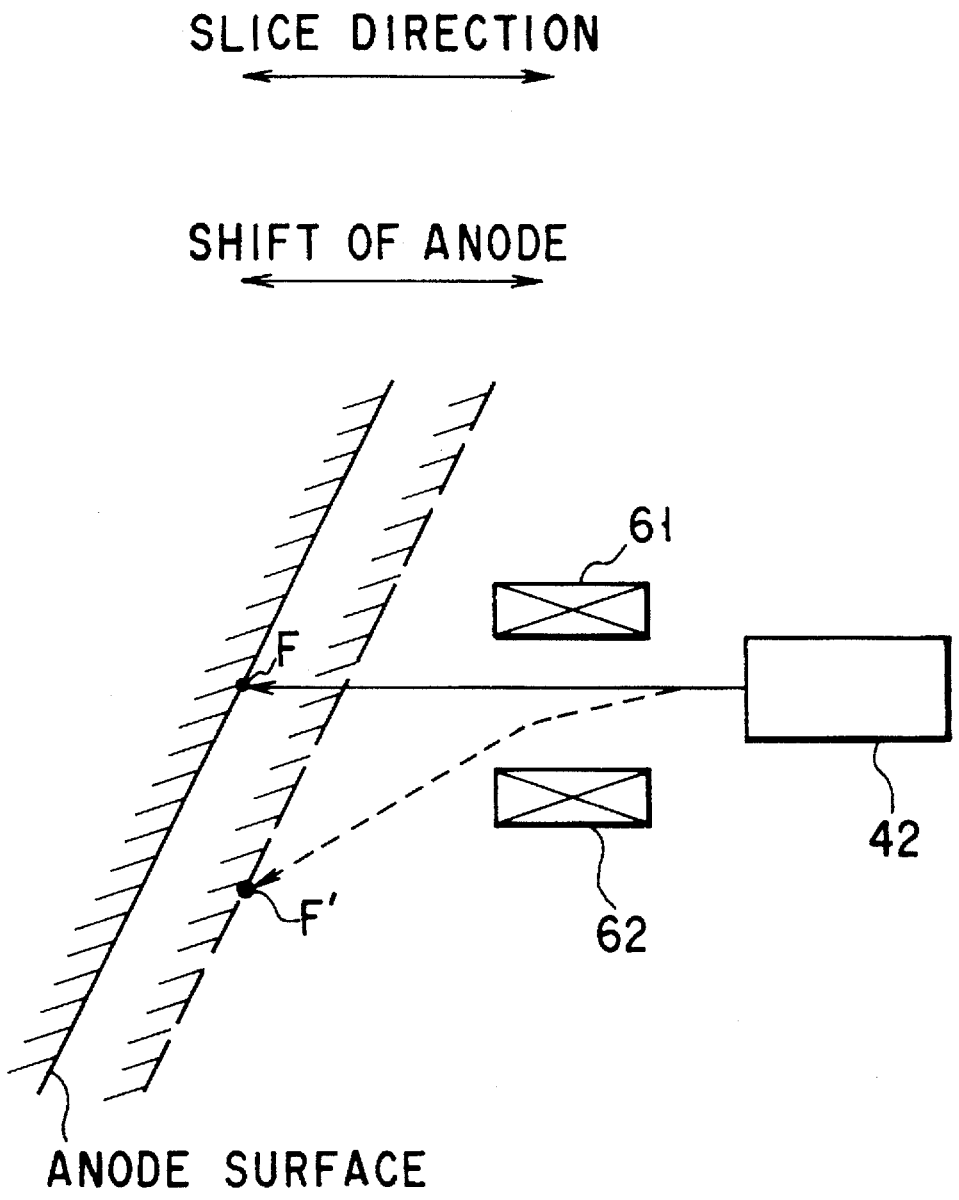
FIG. 23 illustrates a shift of the X-ray focal point by the focal point shifting unit of FIG. 20 based on the second principle.

The second principle will be described next. The focal point shifting unit 60 according to the second principle comprises deflection coils 61 and 62 which oppose to each other along the electronic beam path extending from the cathode 42 (shown in FIG. 22) to the target 43 and a voltage supply means (not shown) for supplying the deflection coils with voltage under control of the host controller 20. FIG. 23 illustrates the second principle. Solid lines indicate the surface of the target 43 and the electron beam traveling path at the time of room temperature, while dotted lines indicate the surface of the target and an electron beam traveling path at the time of high temperature. The above reference position is the position of the X-ray focal point when the target 43 is maintained at room temperature. The target 43 is normally slanted with respect to the electron beam traveling path at the time of room temperature in order to emit X-rays in the direction of about 90 degrees relative to that path. The target 43 shifts along the slice direction as the shaft 44 expands by heat and the X-ray focal point F shifts accordingly from the reference position towards the cathode 42. Under control of the host controller 20 the voltage supply means supplies the deflection coils 61 and 62 with voltages. As a result, the electron beam is deflected so that, as indicated by the dotted line, it arrives at the position F' on the target 43 which differs from the position F at the time of room temperature but is aligned with F in the direction perpendicular to the slice direction. Thus, the positional relationship among the X-ray focal point F', the slit 23 and the X-ray detector 24 remains unchanged, which permits X-rays to be equally directed onto each of the detector elements of the X-ray detector 24 all the time.

The sensitivity compensation is the same as that in the first embodiment except that only calibration data obtained when the X-ray focal point is located in the reference position is used. More specifically, since the X-ray focal point is always located in the same position (reference position), there is no need for preparing calibration data for each of different positions of the X-ray focal point as in the first embodiment.

The second embodiment provides the same advantages as the first embodiment. In addition, since only calibration data when the X-ray focal point is located in the reference position need to be measured, the calibration data measuring work to be performed previously is facilitated greatly.

Although the present embodiment was described as using a solid-state type of X-ray detector, this is not restrictive. Of course, a conventional ionization chamber type of X-ray detector utilizing Xe gas may be used.

According to the present invention, a plurality of pieces detect or data are previously obtained, as a plurality of pieces of compensation data, by a plurality of X-ray detector elements of an X-ray detector while shifting the position of the X-ray focal point with a water phantom interposed between an X-ray tube and the X-ray detector. At actual tomography imaging time, compensation data corresponding to the current position of the X-ray focal point, which will shift according to the thermal state of the X-ray tube, is selected, and actual detector data obtained when a subject under examination is interposed between the X-ray tube and the X-ray detector is compensated for by the selected compensation data, permitting optimum compensation of variations in sensitivity among the X-ray detector elements for any position of the X-ray focal point, thereby preventing a ring-like artifact from being produced on a tomography image. Further, according to the present invention, the actual X-ray focal point position which shifts according to the thermal state of the X-ray tube is measured, the X-ray focal point is shifted according to the measured position so that it will is located in a reference position all the time, and detector data is compensated for by compensation data previously obtained when the X-ray focal point is located in the reference position, permitting optimum compensation of variations in sensitivity among the X-ray detector elements irrespective of the shift of the X-ray focal point, thereby preventing a ring-like artifact from being produced on a tomography image.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An X-ray computerized tomography apparatus for imaging a subject comprising:

an X-ray tube unit for emitting X rays from an X-ray focal point, the X-ray focal point being movable due to heat generated by the emission of the X rays;

X-ray detector means facing the X-ray tube unit for detecting X rays passing through the subject, the detector means including an array of X-ray detector elements; and position determining means for determining a position of the X-ray focal point in accordance with a history of X-ray emission, the history beginning when the X-ray tube is at an ambient temperature and including information on X-ray tube voltage, X-ray tube current, and periods of X-ray emission and pausing.

2. The X-ray computerized tomography apparatus according to claim 1, in which the position determining means stores data representing curves along which the X-ray focal point is expected to move to a reference position after X-ray emission is terminated, and also data representing distances for which the X-ray focal point is expected to move away from the reference position and which have been measured by varying the tube voltage, the tube current, and the X-ray emission period, and said position determining means determines the position of the X-ray focal point from the curves and the distances in accordance with the history.

3. An X-ray computerized tomography apparatus for imaging a subject comprising:

an X-ray tube unit for emitting X rays from an X-ray focal point, the X-ray focal point being movable due to heat generated by the emission of the X rays;

X-ray detector means facing the X-ray tube unit for detecting X rays passing through the subject, the detector means including an array of X-ray detector elements;

position determining means for determining a position of the X-ray focal point;

storage means for storing compensation data used to achieve uniform sensitivity of the X-ray detector elements, the compensation data having been obtained at a plurality of positions of the X-ray focal point;

compensation means for compensating output signals from said X-ray detector elements in accordance with the compensation data in accordance with the position of the X-ray focal point determined by said position determining means; and reconstruction means for reconstructing a tomography image in accordance with data output from said compensation means.

4. The apparatus according to claim 3, in which said position determining means includes a pair of X-ray detecting elements arranged adjacent to the X-ray detector elements and in the direction of the X-ray focal point movement such that a portion of the X-rays emitted from said X-ray tube unit irradiate the pair of X-ray detecting elements directly, the X-ray detecting elements being equally irradiated at an ambient temperature, and an irradiated area of one of the pair of X-ray detecting elements increases and that of another one of the X-ray detecting elements decreases in accordance with the movement of the X-ray focal point; and position calculating means for calculating the position of the X-ray focal point on the basis of a comparison of output signals from said pair of X-ray detecting elements.

5. The apparatus according to claim 4, in which said pair of detector elements are each comprise a scintillator for converting X-rays to light and a photodiode for converting the light to electricity.

6. The apparatus according to claim 3, in which said position determining means determines the position of the X-ray focal point in accordance with a history of X-ray emission beginning with an ambient temperature of the X-ray tube, said history including time of an emission period and a pause period.

7. The apparatus according to claim 6, in which said position determining means stores data representing curves along which the X-ray focal point is expected to move to a reference position after the X-ray emission is terminated, and also data representing distances for which the X-ray focal point is expected to move away from the reference position and which have been measured by varying the tube voltage, the tube current and the X-ray emission period, and said position determining means determines the position of the X-ray focal point from the curves and the distances in accordance with the history.

8. The apparatus according to claim 3, in which said position determining means comprises a plurality of temperature sensors attached to various components located within said X-ray tube unit, and means for calculating the position of the X-ray focal point based on temperatures detected by said temperature sensors.

9. The apparatus according to claim 8, in which said position determining means multiplies each of the temperatures detected by said temperature sensors by a thermal expansion coefficient of each of said components, adds the multiplying products, calculates a moving distance of the X-ray focal point from the reference position at on ambient temperature on the basis of the added product, and determines a position of the X-ray focal point on the basis of the moving distance.

10. An X-ray computerized tomography apparatus for imaging a subject comprising:

an X-ray tube unit for emitting X rays from an X-ray focal point, the X-ray focal point being movable due to heat generated by the emission of the X rays;

X-ray detector means facing the X-ray tube unit for detecting X rays passing through the subject, the detector means including an array of X-ray detector elements;

position determining means for determining a position of the X-ray focal point;

storage means for storing compensation data used to achieve a uniform sensitivity of the X-ray detector elements at a reference position, the compensation data having been obtained at the reference position;

focal point returning means for returning the X-ray focal point to the reference position in accordance with the position of the X-ray focal point determined by said position determining means;

compensation means for compensating output signals from said X-ray detector elements on the basis of the compensation data; and reconstruction means for reconstructing a tomography image on the basis of data output from said compensation means.

11. The apparatus according to claim 10, in which said position determining means includes a pair of X-ray detecting elements arranged adjacent the X-ray detector elements and such that a portion of the X rays emitted from said X-ray tube unit irradiate said pair of X-ray detecting elements directly, the portion of the X rays equally irradiating said pair of X-ray detecting elements at an ambient temperature, an irradiated area of one of the X-ray detecting elements increases and that of another one of the X-ray detecting elements decreases in accordance with the movement of the X-ray focal point; and position calculating means for calculating the position of the X-ray focal point on the basis of a comparison of output signals from said pair of X-ray detecting elements.

12. The apparatus according to claim 11, in which said position determining means comprises a plurality of X-ray detecting elements arranged in a direction in which the X-ray focal point moves, for receiving some of the X rays emitted from said X-ray tube unit, and position calculating means for calculating the position of the X-ray focal point from differences among outputs generated by said X-ray detecting elements.

13. The apparatus according to claim 11, in which said detector elements are each comprise a scintillator for converting X-rays to light and a photodiode for converting the light to electricity.

14. The apparatus according to claim 13, in which the number of said detector elements is two, and said two detector elements are equally irradiated with said some of the X rays when said X-ray focal point is located at a reference position.

15. The apparatus according to claim 10, in which said position determining means determines the position of the X-ray focal point in accordance with a history of X-ray emission, the history beginning when the X-ray tube unit is at an ambient temperature and including information on periods of X-ray emission and pausing.

16. The apparatus according to claim 15, in which said position determining means obtains said history from a tube voltage and a tube current to be applied and supplied to said X-ray tube unit, a time at which said X-ray tube unit is to start emitting X rays, and a period during which said X-ray tube unit is to keep emitting X rays to the subject.

17. The apparatus according to claim 15, in which said position determining means stores data representing curves along which the X-ray focal point is expected to move to a reference position after the X-ray emission is terminated, and also data representing distances for which the X-ray focal point is expected to move away from the reference position and which have been measured by varying the tube voltage, the tube current and the X-ray emission period, and said position determining means determines the position of the X-ray focal point from the curves and the distances in accordance with the history.

18. The apparatus according to claim 10, in which said position determining means comprises a plurality of temperature sensors attached to various components located within said X-ray tube unit, and means for calculating the position of the X-ray focal point based on temperatures detected by said temperature sensors.

19. The apparatus according to claim 18, in which said position determining means multiplies each of the temperatures detected by said temperature sensors by a thermal expansion coefficient of said each of components, adds for the multiplying products calculates a moving distance of the X-ray focal point from the reference position at low temperature on the basis of the adding product, and determines a position of the X-ray focal point on the basis of the moving distance.

20. The apparatus according to claim 10, in which the focal point returning means moves the X-ray tube unit such that the X-ray focal point returns to the reference position.

21. The apparatus according to claim 10, in which said X-ray tube unit includes a cathode for emitting an electron beam and an anode having a surface inclined to a path in which the electron beam travels from said cathode, for emitting X rays from a point on said surface when bombarded with the electron beam, said anode is shifted along said path in accordance with a thermal state of said X-ray tube unit, to thereby shift the X-ray focal point from the reference position, and the X-ray focal point shifting means deflects the electron beam, to thereby apply the electron beam onto that position on the surface of said anode which is identical to the reference position with respect to the path of the electron beam.

22. An X-ray computerized tomography apparatus for imaging a subject comprising:

an X-ray tube unit for emitting X rays from an X-ray focal point, the X-ray focal point being movable due to heat generated by the emission of the X rays;

X-ray detector means facing the X-ray tube unit for detecting X rays passing through the subject, the detector means including an array of X-ray detector elements; and position determining means for determining a position of the X-ray focal point, including a pair of X-ray detecting elements arranged such that a portion of the X-rays emitted from said X-ray tube unit directly irradiate said pair of X-ray detecting elements, the portion of the X rays equally irradiating said pair of X-ray detecting elements at an ambient temperature, an irradiated area of one of the pair of X-ray detecting elements increases and that of the other one of the pair of X-ray detecting elements decreases in accordance with the movement of the X-ray focal point, and said pair of X-ray detecting elements being arranged adjacent to said X-ray detector elements, and calculating means for calculating the position of the X-ray focal point on the basis of a comparison of output signals from said pair of X-ray detecting elements.

23. An X-ray computerized tomography apparatus for imaging a subject comprising:

an X-ray tube unit for emitting X rays from an X-ray focal point, the X-ray focal point being movable due to heat generated by the emission of the X rays;

X-ray detector means facing the X-ray tube unit for detecting X rays passing through the subject, the detector means including an array of X-ray detector elements; and position determining means for determining a position of the X-ray focal point comprising at least one temperature sensor attached to various components located within said X-ray tube unit, and means for calculating the position of the X-ray focal point on the basis of a temperature detected by said temperature sensor.

24. An X-ray computerized tomography apparatus for imaging a subject comprising;

an X-ray tube unit for emitting X rays from an X-ray focal point, the X-ray focal point being movable due to heat generated by the emission of the X rays;

X-ray detector means facing said X-ray tube unit for detecting X rays passing through the subject, the detector means including an array of X-ray detector elements for detecting X-rays transmitted through the subject; and position determining means for determining a position of the X-ray focal point comprising a pair of X-ray detecting elements and calculating means for calculating the position of the X-ray focal point on the basis of a comparison of output signals from said pair of X-ray detecting elements, said pair of X-ray detecting elements arranged such that the comparison of the output signals changes in accordance with the movement of the X-ray focal point and such that the part of the X-rays emitted from said X-ray tube unit directly irradiate said pair of X-ray detecting elements, said pair of X-ray detecting elements arranged adjacent to said X-ray detector elements.

25. An X-ray computerized tomography apparatus for imaging a subject comprising:

an X-ray tube unit for emitting X rays from an X-ray focal point, the X-ray focal point being movable due to heat generated by the emission of the X rays;

an array of X-ray detector elements facing the X-ray tube unit for detecting X rays passing through the subject;

a memory device for storing data representative of focal point movement as a function of voltage, current, and X-ray emission time of the X-ray tube;

a measuring unit for measuring the voltage, current and X-ray emission time of the X-ray tube; and a CPU for calculating from the stored data the position of the X-ray focal point as a function of the measured voltage, current and X-ray emission time of the X-ray tube.

26. An X-ray computerized tomography apparatus for imaging a subject comprising:

an X-ray tube unit for emitting X rays from an X-ray focal point, the X-ray focal point being movable due to heat generated by the emission of the X rays;

an array of X-ray detector elements facing the X-ray tube unit for detecting X rays passing through the subject;

at least one temperature sensor attached to various components located within said X-ray tube unit; and a CPU for calculating the position of the X-ray focal point on the basis of a temperature detected by the at least one temperature sensor.

27. An X-ray computerized tomography apparatus for imaging a subject comprising;

an X-ray tube unit for emitting X rays from an X-ray focal point, the X-ray focal point being movable due to heat generated by the emission of the X rays;

an array of X-ray detector elements for detecting X-rays transmitted through the subject;

a pair of X-ray detecting elements; and a CPU for calculating the position of the X-ray focal point on the basis of a comparison of output signals from said pair of X-ray detecting elements, said pair of X-ray detecting elements arranged such that the comparison of the output signals changes in accordance with the movement of the X-ray focal point and such that the part of the X-rays emitted from said X-ray tube unit directly irradiate said pair of X-ray detecting elements, said pair of X-ray detecting elements arranged adjacent to said X-ray detector elements.

* * * * *

UNITED STATES PATENT AND TRADEMARK OFFICE

CERTIFICATE OF CORRECTION

PATENT NO. : 5,566,220

DATED : October 15, 1996

INVENTOR(S) : Yasuo SAITO et al.

It is certified that error appears in the above-indentified patent and that said Letters Patent is hereby corrected as shown below:

In the Abstract, line 5, after "measured as", delete "a".

Claim 5, column 12, line 57, "comprise a" should read --comprised of a--.

Claim 13, column 14, line 8, "comprise a" should read --comprised of a--.

* Claim 13, column 14, line 9, "X-rays" should read --X rays--.

Signed and Sealed this

Thirteenth Day of May, 1997

Bruce Lehman

*Attest:*

BRUCE LEHMAN

*Attesting Officer*

*Commissioner of Patents and Trademarks*